US011417201B2

(12) United States Patent
Britton et al.

(10) Patent No.: US 11,417,201 B2
(45) Date of Patent: Aug. 16, 2022

(54) SYSTEM AND METHOD FOR ENTRY CHECK-IN PROTECTION

(71) Applicant: DIGITAL MONITORING PRODUCTS, INC., Springfield, MO (US)

(72) Inventors: Rick A. Britton, Springfield, MO (US); David M. Roberts, Springfield, MO (US)

(73) Assignee: DIGITAL MONITORING PRODUCTS, INC., Springfield, MO (US)

( * ) Notice: Subject to any disclaimer, the term of this patent is extended or adjusted under 35 U.S.C. 154(b) by 0 days.

(21) Appl. No.: 16/576,550

(22) Filed: Sep. 19, 2019

(65) Prior Publication Data

US 2020/0090495 A1 Mar. 19, 2020

Related U.S. Application Data

(60) Provisional application No. 62/733,572, filed on Sep. 19, 2018.

(51) Int. Cl.

| | |
|---|---|
| ***G08B 29/26*** | (2006.01) |
| ***G08B 29/18*** | (2006.01) |
| ***G08B 25/00*** | (2006.01) |
| ***G08B 29/12*** | (2006.01) |

(52) U.S. Cl.

CPC ..... *G08B 29/185* (2013.01); *G08B 25/006* (2013.01); *G08B 25/007* (2013.01); *G08B 29/123* (2013.01)

(58) Field of Classification Search

CPC ..... G08B 25/14

See application file for complete search history.

(56) References Cited

U.S. PATENT DOCUMENTS

| | | | |
|---|---|---|---|
| 4,371,751 | A | 2/1983 | Hilligoss, Jr. et al. |
| 4,772,876 | A | 9/1988 | Laud |
| 4,791,658 | A | 12/1988 | Simon et al. |
| 4,825,457 | A | 4/1989 | Lebowitz |
| 5,125,021 | A | 6/1992 | Lebowitz |
| 5,140,308 | A | 8/1992 | Tanaka |
| 5,146,486 | A | 9/1992 | Lebowitz |
| 5,185,779 | A | 2/1993 | Dopp et al. |

(Continued)

*Primary Examiner* — Joseph H Feild
*Assistant Examiner* — Pameshanand Mahase
(74) *Attorney, Agent, or Firm* — Avek IP, LLC; Mark C. Young

(57) ABSTRACT

This disclosure pertains to a system and method configured provide entry check-in protection of a protected premises network including a central alarm monitoring station in communication with a plurality of protected premises, each protected premises comprises a protected premises panel configured to provide entry check-in protection. Protected premises panels include processors and memory configured to provide entry check-in protection comprising receiving an indication of a zone violation of the monitored premises, transmitting a check-in message to the central alarm monitoring station, and transmitting an alert, by the central alarm monitoring station, indicating a destruction of the protected premises panel, upon expiration of the predetermined entry delay period. The check-in message includes a duration corresponding to the entry delay time plus a set period, e.g., one minute.

16 Claims, 3 Drawing Sheets

(56) References Cited

U.S. PATENT DOCUMENTS

| | | | | |
|---|---|---|---|---|
| 5,337,342 | A | 8/1994 | Kruger et al. | |
| 5,365,568 | A | 11/1994 | Gilbert | |
| 5,454,024 | A | 9/1995 | Lebowitz | |
| 6,040,770 | A * | 3/2000 | Britton | G08B 25/004 340/506 |
| 6,255,945 | B1 | 7/2001 | Britton | |
| 6,650,238 | B1 * | 11/2003 | Britton | G08B 25/004 340/286.02 |
| 2004/0086088 | A1 * | 5/2004 | Naidoo | H04M 11/04 379/37 |
| 2008/0025487 | A1 * | 1/2008 | Johan | H04L 12/66 379/106.01 |
| 2008/0079561 | A1 * | 4/2008 | Trundle | G08B 25/002 340/506 |
| 2013/0332430 | A1 * | 12/2013 | Margalit | G06F 9/542 707/695 |
| 2015/0055487 | A1 * | 2/2015 | Hederstierna | G05B 15/02 370/242 |
| 2017/0063968 | A1 * | 3/2017 | Kitchen | H04L 65/1033 |
| 2017/0227965 | A1 * | 8/2017 | Decenzo | H04L 12/2809 |
| 2020/0345307 | A1 * | 11/2020 | Gray | A61B 5/6891 |

* cited by examiner

SYSTEM AND METHOD FOR ENTRY CHECK-IN PROTECTION

CROSS-REFERENCE TO RELATED APPLICATION

The present application claims priority to U.S. Provisional Patent Application No. 62/733,572, filed Sep. 19, 2018, entitled "SYSTEM AND METHOD FOR ENTRY CHECK-IN PROTECTION," which is incorporated herein by reference in its entirety.

BACKGROUND

1. Field

The present disclosure pertains to a system and method for entry check-in protection of premises-monitoring alarm systems.

2. Description of the Related Art

Commercial solutions for providing entry protection are known. Premises monitoring alarm systems, however, often require subscriber sites to wait passively for interrogation. Many commercial solutions require the use of a network operating center (NOC), or third-party retransmission, consisting of many servers that communicate and retransmit an alarm to the central station upon determination that one should exist.

SUMMARY

The exemplary implementations described herein utilize a protected premises panel that communicates with a receiver in order to provide communication path integrity supervision and entry check-in protection in an effective and simple manner without the use of a NOC or third-party retransmission of the alarm.

Accordingly, one or more aspects of the present disclosure relate to an alarm monitoring system configured to provide entry check-in protection of a network of monitored premises. The system comprises a central alarm monitoring station, a plurality of monitored premises, each monitored premises of the plurality of monitored premises each comprising a protected premises panel. In some embodiments, the alarm monitoring system is configured to receive, by a protected premises panel, an indication of a zone violation event corresponding to a monitored premises of the plurality of monitored premises, the monitored premises corresponding to the protected premises panel. In some embodiments, the alarm system may then transmit, by the protected premises panel, a check-in message to the central alarm monitoring station, the check-in message comprising a predetermined supervision period. In some embodiments, the system is configured to transmit an alert, by the central alarm monitoring station, indicating the destruction of the protected premises panel, upon expiration of the predetermined supervision period.

Another aspect of the present disclosure relates to a method configured to provide entry check-in protection of a network of monitored premises utilizing an alarm monitoring system comprising a central alarm monitoring station and a plurality of monitored premises, wherein each monitored premises of the plurality of monitored premises includes a protected premises panel. In some embodiments, the method comprises receiving, by a protected premises panel, an indication of a zone violation event corresponding to a monitored premises of the plurality of monitored premises, the monitored premises corresponding to the protected premises panel. The method includes transmitting, by the protected premises panel, a check-in message to the central alarm monitoring station, the check-in message comprising a predetermined supervision period. In some embodiments, the method continues by transmitting an alert, by the central alarm monitoring station upon expiration of the predetermined supervision period, the alert indicating the a destruction of the protected premises panel.

These and other aspects, features, and characteristics of the present disclosure, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the disclosure.

DETAILED DESCRIPTION OF EXEMPLARY EMBODIMENTS

Figure 1:
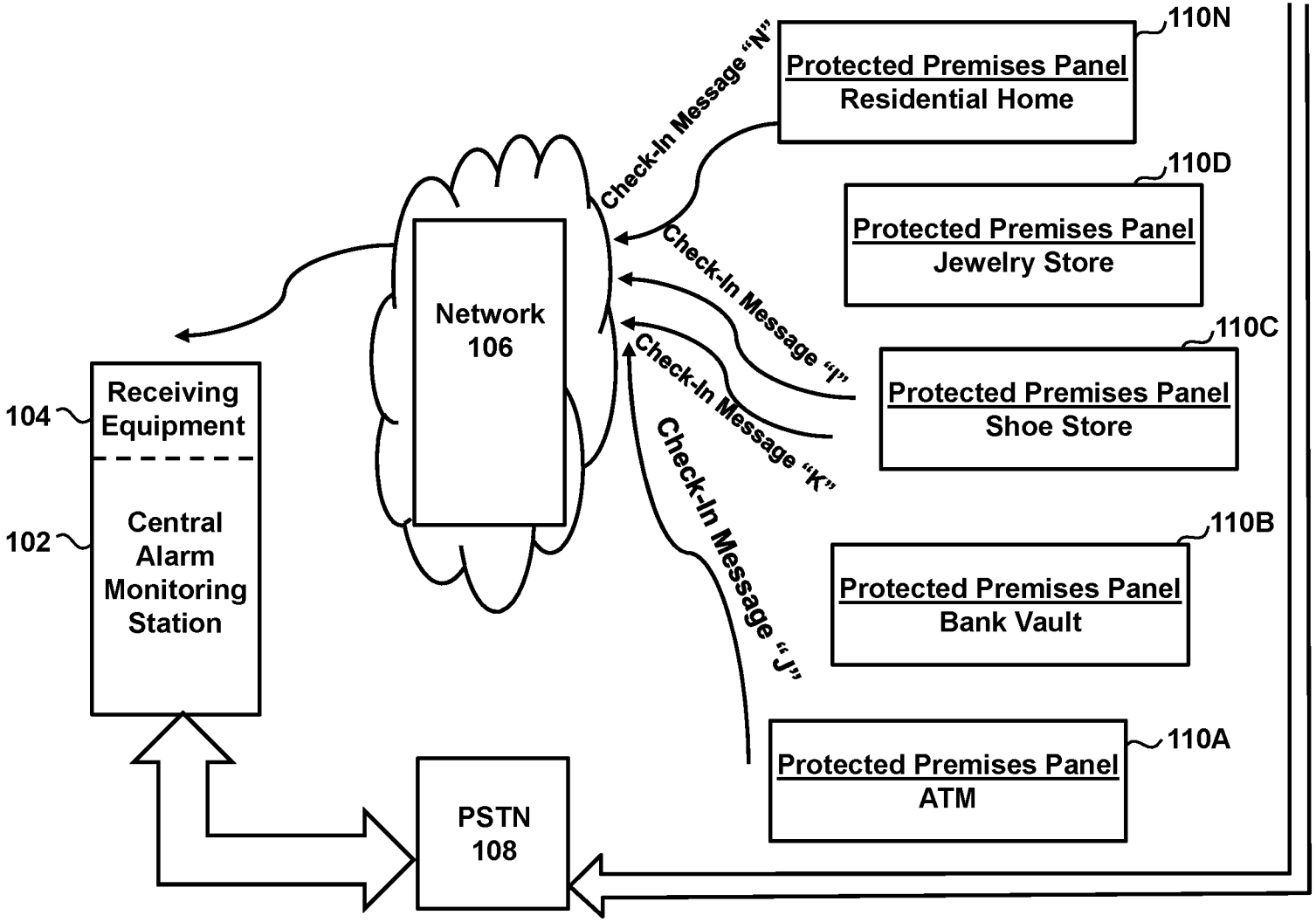
FIG. 1 is a schematic illustration of a communication path integrity supervision system including entry check-in protection in accordance with one or more embodiments.

As used herein, the singular form of "a", "an", and "the" include plural references unless the context clearly dictates otherwise. As used herein, the statement that two or more parts or components are "coupled" shall mean that the parts are joined or operate together either directly or indirectly (i.e., through one or more intermediate parts or components, so long as a link occurs). As used herein, "directly coupled" means that two elements are directly in contact with each other. As used herein, "fixedly coupled" or "fixed" means that two components are coupled so as to move as one while maintaining a constant orientation relative to each other. As used herein, "operatively coupled" means that two elements are coupled in such a way that the two elements function together. It is to be understood that two elements "operatively coupled" does not require a direct connection or a permanent connection between them.

As used herein, the word "unitary" means a component is created as a single piece or unit. That is, a component that includes pieces that are created separately and then coupled together as a unit is not a "unitary" component or body. As employed herein, the statement that two or more parts or components "engage" one another shall mean that the parts exert a force against one another either directly or through one or more intermediate parts or components. As employed herein, the term "number" shall mean one or an integer greater than one (i.e., a plurality).

Directional phrases used herein, such as, for example and without limitation, top, bottom, left, right, upper, lower, front, back, and derivatives thereof, relate to the orientation of the elements shown in the drawings and are not limiting upon the claims unless expressly recited therein.

The exemplary embodiments described herein employ a communication path integrity supervision system including premises entry check-in protection configured for a network of automatic alarm data transmissions. Some embodiments described herein include a method of detecting the immediate destruction of an alarm system upon entry to a monitored premises. As discussed in further detail below, during the entry delay of a typical alarm system, if a protected premises panel is immediately destroyed beyond the ability to communicate to a central station, the alarm may be defeated and rendered useless.

The exemplary embodiments described herein provide automatic supervision of each remote protected premises panel, including entry check-in protection of the protected premises, regardless of whether the full communication path integrity supervision system is employed or not. According to the exemplary embodiments described herein, communication path integrity supervision and entry check-in protection are implemented in a manner that does not place heavy management, storing, and processing burden on the central alarm monitoring station. Rather, the exemplary embodiments described herein allow for each protected premises panel to provide resources for employing the command path integrity supervision and entry check-in protection, which significantly reduces network traffic and reduces the resource demand on the central alarm monitoring station. Moreover, command path integrity supervision may be managed directly by the central alarm monitoring station, rather than a third party NOC. Doing so reduces the number of potential failure points in the system, thereby increasing accuracy and providing a more robust system.

Referring now to FIG. 1, FIG. 1 depicts a schematic of a communication path integrity supervision system 100. Communication path integrity supervision (CPIS) system 100 may be configured as a networked system for providing automatic alarm data communication. In some embodiments, system 100 may utilize entry check-in protection configured for entry check-in protection of a protected premises, as discussed in detail below. System 100 includes central alarm monitoring station (CAMS) 102 having and/or being able to access receiving equipment 104, network 106, public switched telephone network (PSTN) 108, and protected premises panels 110A, 110B, 110C, 110D . . . 110(*n*). As shown in FIG. 1, panels 110 may be configured to communicate with receiving equipment 104 via network 106, and/or PSTN 108. In some embodiments, panels 110 may be configured with detectors monitoring various monitored areas of a premises (not shown in FIG. 1).

Communication path integrity supervision system 100 in accordance with one or more embodiments, is accomplished by each of protected premises panels 110A-110(*n*) dispatching a self-initiated "check-in" message to receiving equipment 104 of CAMS 102. In some embodiments, panels 110A-110(*n*) may be configured for intelligent communication with CAMS 102. This "intelligence" in the control panel typically resides in programmable processing circuits and/or components as well as associated memory circuits and/or components and the like. Thus, panels 110A-110(*n*) may be configured with one or more processors and memory (not shown) configured to execute non-transitory machine readable instructions in order to establish a link to CAMS 102 and transmit alarm signals. In some embodiments, panels 110A-110(*n*) may be configured for packet data transmission via network 106. Packet data messages can include relatively high level content including expressions of exactly which detector is armed or what alarm area is armed.

As mentioned above, in some embodiments, system 100 includes processors and associated memory devices for implementing the exemplary embodiments described herein. Processors and memory devices as utilized herein may include processing circuitry including but not limited to: storage buffers, analog-to-digital converters (ADCs), data registers, field programmable gate arrays (FPGAs), latches, CMOS inverters, interrupt/polling circuitry, timestamping circuitry, and/or other solid-state circuitry (e.g., amplifiers and filters. In some embodiments, processors may include one or more of: a digital processor, an analog processor, a digital circuit designed to process information, an analog circuit designed to process information, a state machine, and/or other mechanisms for electronically processing information. Although processors may be implemented as single entities, or in some embodiments, processors may include a plurality of processing units. These processing units may be physically located within the same device (e.g., protected premises panel 110, receiving equipment 104, and/or CAMS 102), or may represent processing functionality of a plurality of devices operating in coordination (e.g., protected premises panel 110, receiving equipment 104, and/or CAMS 102).

In some embodiments, memory devices utilized by system 100 may include (not shown in FIG. 1) non-transitory machine-readable instructions configured for executing the exemplary embodiments described herein. Non-transitory machine-readable instructions may include program instructions in source code, object code, firmware, executable code or other formats for performing the exemplary embodiments described herein. In some embodiments, system 100 memory devices (not shown) may include conventional computer system RAM (random access memory), ROM (read only memory), EPROM (erasable, programmable ROM), EEPROM (electrically erasable, programmable ROM), Flash memory, and/or magnetic or optical disks or tapes, and the like.

According to the invention, each control panel 110A-110(*n*) may be further configured or programmed, via one or more processors executing non-transitory machine readable instructions stored in memory, to initiate "check-in" messaging to receiving equipment 104 of central alarm monitoring station 102. In some embodiments, receiving equipment 104 is relatively passive in supervising communication path integrity. Because CAMS 102 must manage communication and remote premises monitoring to potentially thousands of protected premises locations, implementing a passive role for CAMS 102 greatly reduces processing power requirements of CAMS 102 and provides for efficient monitoring of many protected premises at reduced energy costs incurred by CAMS 102.

In some embodiments, receiving equipment 104, may be configured to store and manage a Check-In Supervision Table. In order to further reduce system requirements for CAMS 102, receiving equipment 104 may include one or more processors and memory storing non-transitory machine readable instructions that may be configured to manage and store a Check-In Supervision Table in the memory to tabulate and organize the incoming "check-in" messages from panels 110A-110(*n*). As shown in FIG. 1, panels 110A-110(*n*) may be configured to transmit check-in message (i)-(n). Implementing check-in messages in this manner provides communication with CAMS 102 without the need for multiplexing, or polling/interrupts (i.e., interrogating the protected premises 110A-110(*n*)), as discussed further below.

In some embodiments, receiving equipment 104 and protected premises panels 110 may be configured in accordance with the following example implementation. Network 106 may be configured as primarily communicating over a public wireless packet data network, although other Wide Area Networks would suffice as the primary communication link including without limitation cellular networks or proprietary fiber optic or conductor cable networks. As shown in FIG. 1 system 100 may be configured to implement communication between CAMS 102 and premises 110A-110(*n*) utilizing public switched telephone network (PSTN) 108. Although network 106 and PSTN 108 as described above are particularly well suited for implementing the exemplary embodiments described herein, other communication protocols may be implemented without diverting from the scope of the exemplary embodiments described herein and have been fully contemplated.

In some embodiments, CPIS system 100 may be configured having each protected premises panel 110 initiating a "check-in" message. Receiving equipment 104 may be configured to acknowledge the receipt of the check-in message and store check-in message contents in a Check-In Supervision Table (e.g., in memory of receiving equipment 104).

In some embodiments, panels 110A-110(*n*) may be configured to transmit "check-in" messages to CAMS 102, wherein the check-in messages including one or more predetermined criteria, including but not limited to an account number, a system message, and/or a time modifier. In some embodiments, an exemplary "Next Check-In Message" format is shown as follows, in hexadecimal units:

09AC 20002 s0700043
xcccc_aaaaa_mmmmddtt_i
x=ASCII Start of Text (HEX 02)
c=CRC
a=Account Number
m=System Message
d=Zero
t=Time Modifier
_=Space
i=ASCII Carriage Return (HEX 0D)

While operational, CPIS system 100 may be configured wherein each protected premises panel 110 generates an indefinite succession of "Next Check-In Message(s)." Each Next Check-In Message may be configured to test the communication channel (not shown in FIG. 1) between the protected premises panel 110 and receiving equipment 104 for a compromise. Check-in message contents describe to receiving equipment 104 the maximum number of minutes that can pass before panel 110 transmits the Next Check-In Message. In effect, the communication channel is supervised by the continual transmission of these check-in messages.

In some embodiments, the range of time between Next Check-In Message(s) may be determined by panel programming (e.g., executed by processors and memory storing non-transitory machine readable instructions). In some embodiments, the preferred choices may include the value zero (0) minutes and then extend between extreme values in a range between two (2) and sixty (60) minutes or between two (2) and two hundred forty (240) minutes. In some embodiments, the range may include between one (1) and one hundred twenty (120) minutes. As discussed further below, in some embodiments, including a value of zero (0) minutes disables supervision. In some embodiments, a choice of a value or interval between two (2) and sixty (60) minutes, one (1) and one hundred twenty (120) minutes, or two (2) and two hundred forty (240) minutes, causes the succeeding Next Check-In Message scheduled to be sent to receiving equipment 104, to be sent about a minute before the expiration of the chosen interval. Panels 110 may transmit the succeeding Next Check-In Message one (1) minute, for example, before the lapse of time of the value of the predecessor Next Check-In Message transmitted to the receiving equipment 104, and whose value was stored in the Check-In Supervision Table stored by receiving equipment 104.

For example, in some embodiments, panel 110(*n*) may operate in accordance with the following implementation. Panel 110 may be configured to transmit a Next Check-In Message in six (6) minutes. After the expiration of Five (5) minutes, panel 110(*n*) may successfully transmit another Next Check-In Message in six (6) minutes. Then, after another five (5) minutes, panel 110(*n*) may be configured to successfully transmit still another Next Check-In Message in six (6) minutes, and so on. Thus, each panel 110 may be programmed to transmit repeated values of six (6) minutes so that upon every five or six minute interval, each panel 110 checks in with receiving equipment 104. Receiving equipment 104 may process (e.g. using processors and memory) each successfully received Next Check-In Message by updating the Check-In Supervision Table stored on memory.

In some embodiments, if receiving equipment 104 fails to receive a scheduled or appointed Next Check-In Message within the proscribed lapse of time, receiving equipment 104 may generate an "alert" signal for that protected premises panel 110(*n*). Receiving equipment 104 will not generate multiple "alert" signals if receiving equipment 104 never receives another next Check-In Message. Rather, only the first failure will result in generation of an "alert" signal, which provides reduced network traffic and improves the networked CPIS system 100.

In some embodiments, how the "alert" condition is handled by CAMS 102 depends on a given premises. For example, a failure from the jewelry store or bank vault to check-in at night will likely result in police dispatch. While for the shoe store the result might be a phone call to the owners or managers, or some other responsible party, rather than immediately directly involving the police.

As discussed above, in some embodiments, CPIS system 100 may implement a Next Check-In Message sequence occurring at regular intervals, and more specifically, at between five (5) and six (6) minute intervals. In one embodiment, the foregoing mode of communication path integrity supervision may be preferred during nighttime. In another embodiment, during daytime, a different mode of communication path supervision may be preferred (e.g., no immediate police dispatch). For example, panels 110 may be programmed to switch at dawn and dusk between the different modes as desired.

In some embodiments, the preferred daytime mode includes a random value generator to randomly generate a value between two (2) and sixty (60) minutes as the chosen time parameter for any given Next Check-In Message. For example, for any particular panel 110(*n*), panel 110(*n*) may be configured to transmit a given Next Check-In Message corresponding to thirty-seven (37) minutes. Accordingly, thirty-six (36) minutes later, panel 110(*n*) may attempt to successfully transmit another Next Check-In Message, wherein the random-value-generator parameter may be chosen, for example, as seventeen (17) minutes. If the transmission of the check-in message corresponding to the value seventeen (17) is properly received by the receiving equipment 104—before the expiration of the thirty-seventh (37th) minute—then the integrity of the communication path for panel 110(*n*) has been proven. Receiving equipment 104 thus updates the Check-In Supervision Table with the time value "17 minutes" against the record of panel 110(*n*). In time, panel 110(*n*) will proceed to transmit a following Next Check-In Message within the scheduled seventeen (17) minute interval, and so on, endlessly, with successive random values chosen from between two (2) and sixty (60) minutes.

In some embodiments, when any area of panel 110(*n*) is armed, panel 110(*n*) may switch modes back to the more conservative non-randomly generated value of six (6) minutes only between checking. As long as all areas of the panel are disarmed, the value for the Next Check-In Message can be randomly chosen from between six (6) and sixty (60). The foregoing alternate modes of communication integrity path supervision system 100 in accordance with the exemplary embodiments described herein satisfy the requirements of the Underwriters Laboratories for devices of this type.

In some embodiments, a check-in message having the zero (0) time value, means that a given protected premises panel 110(*n*) will cease transmitting Next Check-In Messages. In other words, the zero (0) or null value allows a protected premises panel 110(*n*) to check itself OFF the network, i.e. a check-off message. Receiving equipment 104 may respond by not generating an alert signal for failure to receive a Next Check-In Message. As discussed above, the zero (0) or null value allows any panel 110 to sign off the network without tripping an alert condition. This is especially desirable, for example, during routine maintenance or service. The process of dropping a panel off a "receiver-polling" network ordinarily requires human intervention at the receiver end. Thus, CPIS system 100 allows for a subscriber at the subscriber site (e.g., protected premises panel 110(*n*)) to take panel 110(*n*) off the network by disarming within the programmed entry delay time, which is a much simpler process than involved with a "receiver-polling" protocol.

FIG. 1 illustrates the transmission of random value messaging appearing on a network. In some embodiments, CPIS system 100 employs a random value mode, wherein the various protected premises 110 check in at all different lengths of intervals, in no particular sequence relative to one another, indefinitely, through message number "n" and upwards. For example, assume that protected premises of the shoe store, panel 110C, is scheduled to transmit a Next Check-In Message at this instance. When panel 110C transmits the Next Check-in Message, for example, Next Check-In Message "i", Next Check-In Message "i" may be transmitted to receiving equipment 104. Assuming, for example, that the shoe store panel 110C sent a message in eight (8) minutes. The next protected premises scheduled to contact the receiving equipment may be the ATM machine panel 110A. Thus, the ATM machine panel 110A may transmit Next Check-In Message "j" in which the ATM machine panel 110A recites that the new interval will be thirty-seven (37) minutes. At this point, the next panel scheduled to transmit a check-in message is the shoe store panel 110C again. All the other protected premises had successfully contacted receiving equipment 104 before the transmission of Next Check-In Message "i," except that the other panels had sent a much higher value of a time interval than eight (8) minutes. Thus, the other panels are not scheduled to contact receiving equipment 104 for some time yet, but the shoe store panel 110C is scheduled to go next. Accordingly, panel 110C may transmit the Next Check-In Message "k", seven (7) minutes after reception of Next Check-In Message "i." Implemented in this manner, randomized check-ins allow each individual protected premises 110(*a*)-110(*n*) to manage and alter the value of their own next check-in period.

As shown in FIG. 1, each protected premises panel 110 is alternatively connected to CAMS 102 by network 106 and/or PSTN 108. Alternative connections 102, 108 gives protected premises panels 110 a back-up communication path to transmit alarm signals to CAMS 102. Premises phone lines are also available for transmission of a nightly Recall Test report. Reserving the premises phone line for back-up communication purposes and/or brief nightly reports only, avoids interfering with that phone line's usage during normal business hours.

Actual usage of CPIS system 100 utilizing communication path integrity supervision having the control panels 110A-110(*n*) responsible for periodically checking themselves in with receiving equipment 104, has proven to have great advantages. For example, in some embodiments, CPIS system 100 may be configured for use by a national bank having ATM machines spread out across the country on the order of thousands or more. National bank may include a private packet data network (e.g., network 106) to handle transmission of internal accounting data as well as e-mail and like business traffic. This network is patched together from a conglomerate of resources including privately owned conductor-cables, leased fiber optic cables, with cellular and even satellite links in places (e.g., network 106). The amount of business traffic passing over this network far surpasses the traffic handled by the telephone system (e.g., PSTN 108).

In accordance with one or more embodiments described herein, a protected premises panel 110 may be implemented on each of the national bank's 1000 or more ATM machines. The primary communication path(s) allowed for use of message transmission by these 1000 new panels 110, may include the bank's existing private data network. Based on one or more embodiments described herein, plugging in 1000s of new panels 110 does not require the bank to physically expand its data network by one line or cable. The 1000 or so new panels integrated on the network may be implemented without slowing by any practical measure the existing business traffic over the network (e.g., network 106).

More significantly, central receiving equipment 104 does not require physical expansion to include a 1000 or more matching terminals or a 1000 or more dedicated microprocessors. CPIS system 100 in accordance with one or more embodiments loads seamlessly onto a host computer. The host does not require either an upgrade in processor power, or an enlargement of memory. All that may be required at CAMS 102 is loading the host (panels 110A-110(*n*)) with a modest software package that allowed processing of the automatic alarm messages, including routines to handle "Next Check-in" message traffic, as described above, and entry check-in protection, as described further below. That is to say, the memory requirements for storing the above-described Check-In Supervision Table, are modest at least (and perhaps no more a tiny fractional percentage of the rated memory of the Host as whole). Therefore, the experience of the exemplary national bank may be that the bank added multitudes of premises-monitoring alarm systems at remote locations across the whole country without doing any of the following: e.g., (i) without physically enlarging its network by one phone line or cable, (ii) without enhancing its receiving equipment with new terminals or peripheral microprocessor banks, (iii) without increasing its host's processing power, and (iv) without expanding its host's memory.

Furthermore, by employing an exemplary CPIS system 100, the exemplary national bank did not require adding new staff in the operator-manager group attending to the host by reason of the new stream of automatic alarm data across the network. The routine(s) that operate the Check-In Supervision Table operate with minimal maintenance. No longer is there any need for continual data entry and manipulation and flagging.

In some embodiments, the primary communication path extends over the data network 106 while only the back-up line still extends over the PSTN 108. In one embodiment, during the day, when a great fraction of the alarm messaging is transpiring in the random value mode, protected premises panels 110 establish communication transmissions far less frequently than six (6) minute intervals. Because the exemplary embodiments described herein supervise path integrity by sending a check-in message with the appropriate supervision time, therefore, no outward polling from CAMS 102 or receiving equipment 104 is required. Thus, traffic is scaled back over the data network, and correspondingly there is scaled back traffic into receiving equipment 104 as a result of the random value mode. Hence the alarm messaging traffic may not represent anything more than a minuscule percent of the total traffic over data network 106, such that the alarm messaging traffic does not tax data network's 106 capacity by any practical measure.

Additionally, CAMS 102 (or its receiving equipment 104) does not have to be specifically configured as to "who" or "exactly which" subscriber(s) (i.e. which panel(s) 110(*n*)) are on the network. Each protected premises panel 110(*n*) is self-empowered to disconnect from the network by transmitting a Next Check-In Message of zero (0). Re-establishing on the network is as comparably simple. After a long dormancy, any panel 110(*n*) merely needs to transmit a non-zero original Next Check-In Message, and any panel 110(*n*) may be on-line as far as concerns the Check-In Supervision Table.

In some embodiments, CAMS 102 does not need to store or "know" the path or paths (e.g., including associated addresses or phone numbers or electronic serial numbers of cellular transceivers) to access a given panel 110(*n*). Rather, each panel 110 is responsible for establishing the communication path, and each panel 110(*n*) will store more than one path so each panel 110(*n*) may transmit over alternate paths (e.g., PSTN 108) if a primary path or network should fail (e.g., network 106). In some embodiments, panels 110 may be configured to transmit check-in messages to CAMS 102 for providing entry check-in protection upon the detection of a zone violation, which is described in further detail below.

In some embodiments, CPIS system 100 may be configured for implementing entry check-in protection, which provides further automatic supervision of each of the panels 110A-110(*n*). Entry check-in protection may be implemented regardless of whether full communication path integrity supervision is employed or not (e.g., as implemented by CPIS system 100 as discussed above). In some embodiments, when a premises user enters an armed premises, e.g., panel 110(*n*), a predetermined entry delay begins. The predetermined entry delay provides time for a premises user to enter their premises and disarm protected premises panel 110(*n*) (e.g., by entering a numeric code). In one embodiment, the predetermined entry delay time may be programmable from 30 seconds to 250 seconds, or longer or shorter. In some embodiments, upon activation of an alarm area of a protected premises, panel 110(*n*) may be configured to transmit a check-in message to receiving equipment 104 with a scheduled next check-in time comprised of the predetermined programmed entry delay time plus one (for example) minute (e.g., 1 minute of entry plus 1 minute). Providing the additional plus one minute, for example, allows for communication retries in the event of network congestion or cellular communication issues, which increases accuracy of the system. If an authorized premises user disarms panel 110(*n*) within the predetermined entry delay time, panel 110(*n*) may be configured to send a check off message to CAMS 102, via receiving equipment 104. If an authorized premises user does not disarm panel 110(*n*) within the predetermined entry delay time, or panel 110(*n*) is damaged in some way to prevent communication with receiving equipment 104 (e.g., such as may be the case during an attempt to tamper or destroy panel 110(*n*)) receiving equipment 104 may be configured to signal an alert to indicate such a condition (e.g., destruction or tampering of protected premises panel 110(*n*)).

Figure 2:
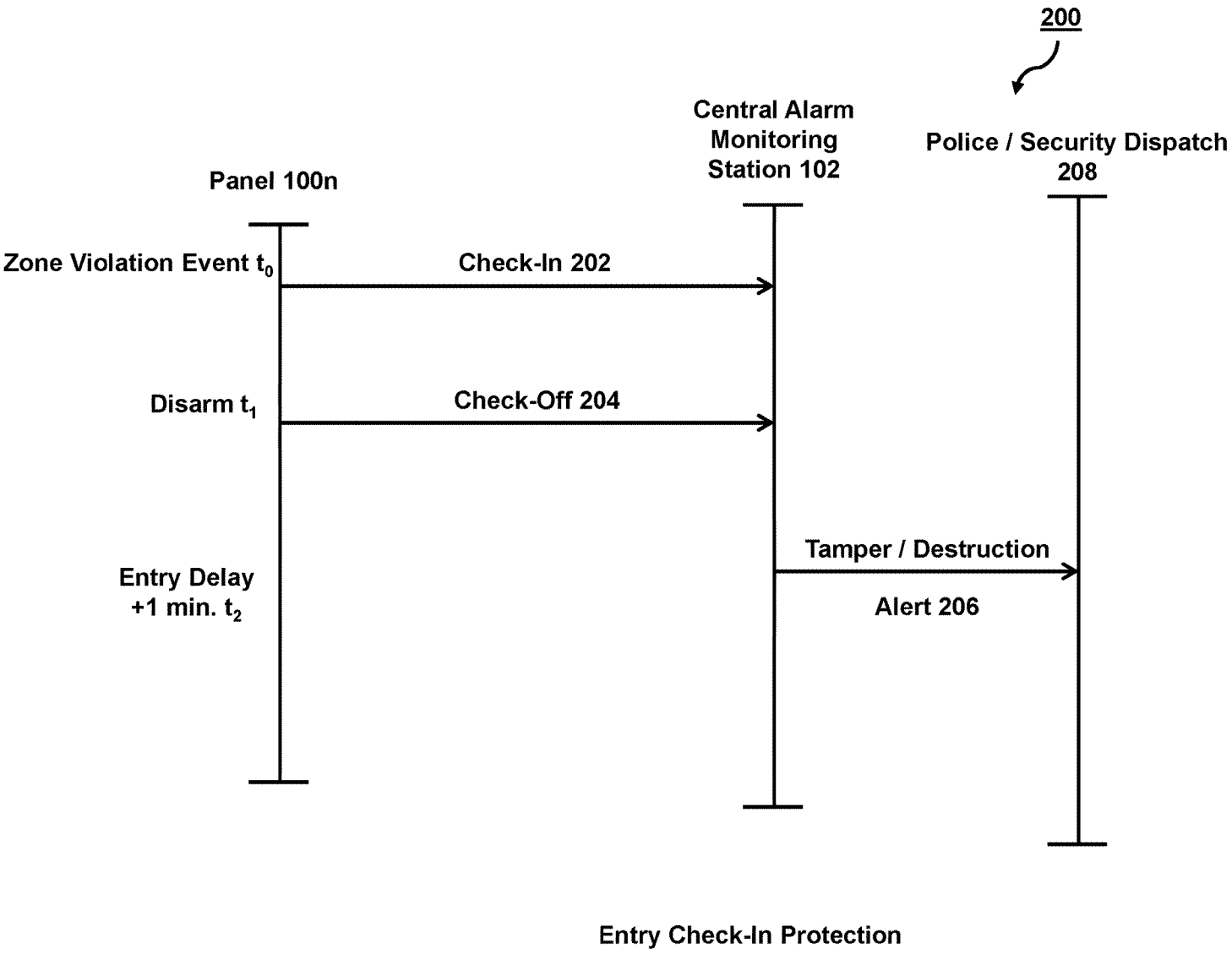
FIG. 2 is an exemplary illustration of a timing diagram of entry-check in protection in accordance with one or more embodiments.

Referring now to FIG. 2 in conjunction with FIG. 1, FIG. 2 depicts a timing diagram of a method for providing entry check-in protection in accordance with one or more embodiments disclosed herein. As shown in FIG. 2, at a time ($t_0$), panel 110(*n*) may be armed and may receive an indication of a zone violation event. The zone violation event may occur upon tripping a sensor in a protected area of the premises. An alarm corresponds to when the user does not disarm the system within the programmed entry delay time after a zone violation event.

For example, a premises user may enter the front door of a protected premises and trip the front door sensor (i.e., a zone violation event), or a premises burglar may enter through a window and trip the window sensor (i.e., a zone violation event). In some embodiments, during a zone violation event, for example when a premises user enters an armed premises and the entry delay begins, panel 110(*n*) may be configured to transmit a check-in message 202 to the central alarm monitoring station 102, via receiving equipment 104. In some embodiments, the transmitted check-in message 202 may include a scheduled next check-in time comprised of a predetermined programmed entry delay time plus one minute. In some embodiments, the predetermined program entry delay time corresponds to the anticipated time a premises user needs to enter the premises and disarm panel 110(*n*). As discussed above, the entry delay time may be programmable and adjusted based on the preference of the user.

As shown in FIG. 2, at time $t_1$, if an authorized premises user disarms panel 110(*n*) within the entry delay time $t_1$, panel 110(*n*) will send a check-off message 204 (i.e. a check-in message with fail time set to zero (0), as described above) to CAMS 102, via receiving equipment 104. The check-off message may include a fail time set to zero (0) or may include a fail time set to the programmed normal path supervision time (e.g., between thirty (30) seconds and two hundred forty (240) seconds as discussed above). If an authorized premises user does not disarm panel 110(*n*) within the entry delay time $t_2$, or CAMS 102 does not receive the check-off message with the fail time set to zero, or other fail time amount, (e.g., panel 110(*n*) is damaged in some way to prevent communication with the central alarm monitoring station 102, such as when a burglar may attempt to destroy panel 110(*n*) and prevent communication with CAMS 102), CAMS 102 will generate an alert signal to indicate a panel not responding condition. In some embodiments, CAMS 102 may then elect a third party dispatch.

Third party dispatch may include dispatching local police or private security, contacting the owner of the premises, and/or contacting another responsible party. Thus, the automatic entry check-in protection employed by CPIS system 100 as discussed above provides protection against destruction of panel 110(*n*) in a simple manner that may be implemented without the use of a Network Operating Center (NOC), which require many servers that communicate and retransmit the alarm, and without the central alarm monitoring station 102 having to expend resources on the management of entry check-in protection.

Figure 3:
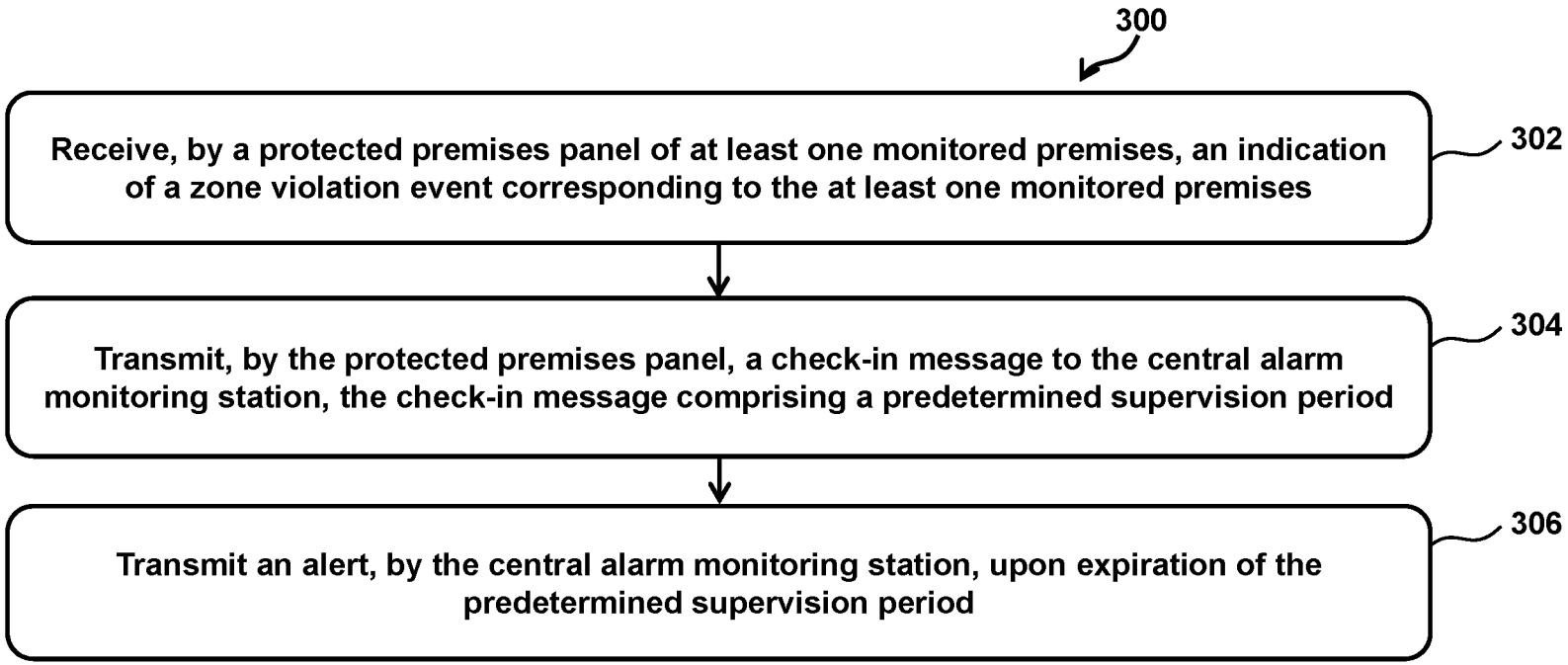
FIG. 3 illustrates a flowchart describing a method for entry check-in protection in accordance with one or more embodiments.

Referring now to FIG. 3, FIG. 3 illustrates a method 300 for providing entry check-in protection of a protected premises panel 110(*n*) in accordance with one or more embodiments. The operations of method 300 presented below are intended to be illustrative. In some embodiments, method 300 may be accomplished with one or more additional operations not described, and/or without one or more of the operations discussed. Additionally, the order in which the operations of method 300 are illustrated in FIG. 3 and described below is not intended to be limiting.

At an operation 302, receiving by a protected premises panel of at least one monitored premises, an indication of a zone violation event corresponding to the at least one monitored premises. Operation 302 may be implemented in the same or similar manner as performed by panel 110(*n*) of FIG. 2. At an operation 304, transmitting, by the protected premises panel, a check-in message to the central alarm monitoring station, the check-in message comprising a predetermined entry delay period. Operation 304 may be implemented in the same or similar manner as performed by panel 110(*n*) of FIG. 2. At an operation 306, transmitting an alert, by the central alarm monitoring station, indicating a destruction of protected premises panel 110(*n*), upon expiration of the predetermined entry delay period. Operation 306 may be implemented in the same or similar manner as performed by central alarm monitoring station 102 of FIG. 2.

In the claims, any reference signs placed between parentheses shall not be construed as limiting the claim. The word "comprising" or "including" does not exclude the presence of elements or steps other than those listed in a claim. In a device claim enumerating several means, several of these means may be embodied by one and the same item of hardware. The word "a" or "an" preceding an element does not exclude the presence of a plurality of such elements. In any device claim enumerating several means, several of these means may be embodied by one and the same item of hardware. The mere fact that certain elements are recited in mutually different dependent claims does not indicate that these elements cannot be used in combination.

Although the description provided above provides detail for the purpose of illustration based on what is currently considered to be the most practical embodiments, it is to be understood that such detail is solely for that purpose and that the disclosure is not limited to the expressly disclosed embodiments, but, on the contrary, is intended to cover modifications and equivalent arrangements that are within the spirit and scope of the appended claims. For example, it is to be understood that the present disclosure contemplates that, to the extent possible, one or more features of any embodiment can be combined with one or more features of any other embodiment.

What is claimed is:

1. A method configured to provide entry check-in protection of a network of monitored premises utilizing an alarm monitoring system, the alarm monitoring system comprising a central alarm monitoring station, the central alarm monitoring station serving at least one monitored premises that includes a protected premises panel, the method comprising:

receiving, by the protected premises panel, an indication of a zone violation event corresponding to the at least one monitored premises;

in response to receipt of the indication of a zone violation event, transmitting, by the protected premises panel, a check-in message to the central alarm monitoring station, the check-in message comprising a predetermined supervision period corresponding to the zone violation event;

receiving, by the central alarm monitoring station, the check-in message transmitted by the protected premises panel;

storing, by the central alarm monitoring station, the supervision period; and transmitting an alert, by the central alarm monitoring station, upon expiration of the predetermined supervision period.

2. The method of claim 1, wherein the alert comprises an indication of destruction of the protected premises panel.

3. The method of claim 1, wherein transmitting the alert, by the central alarm monitoring station, comprises transmitting the alert to a third party dispatch.

4. The method of claim 1, wherein the protected premises panel comprises a communication path integrity supervision system configured to transmit, to the central alarm monitoring station, a plurality of successive check-in messages, each including an anticipated next check-in time corresponding to a predetermined programmable time period.

5. The method of claim 4, wherein the central alarm monitoring station transmits an alert to a third party dispatch upon the expiration of the anticipated next check-in time.

6. The method of claim 1, further comprising:

receiving, by the protected premises panel, within the predetermined supervision period, a disarm event and transmitting a check-off message to the central alarm monitoring station to reset the supervision period.

7. The method of claim 1, further comprising;

adding an additional time period to the predetermined supervision period to compensate for potential network communication delay.

8. The method of claim 1, wherein the supervision period is stored in a check-in supervision table in a memory of the central alarm monitoring station.

9. An alarm monitoring system configured to provide entry check-in protection for a monitored premises, the system comprising:

a central alarm monitoring station; and at least one monitored premises comprising a protected premises panel, wherein the alarm monitoring system is further configured to:

receive, by the protected premises panel, an indication of a zone violation event corresponding to the at least one monitored premises;

in response to receipt of the indication of a zone violation event, transmit, by the protected premises panel, a check-in message to the central alarm monitoring station, the check-in message comprising a predetermined supervision period corresponding to the zone violation event;

receive, by the central alarm monitoring station, the check-in message transmitted by the protected premises panel;

store, by the central alarm monitoring station, the supervision period; and transmit an alert, by the central alarm monitoring station, upon expiration of the predetermined supervision period.

10. The system of claim 9, wherein the alert comprises an indication of destruction of the protected premises panel.

11. The system of claim 9, wherein transmitting the alert, by the central alarm monitoring station comprises transmitting the alert to a third party dispatch.

12. The system of claim 9, wherein the protected premises panel comprises a communication path integrity supervision system configured to transmit, to the central alarm monitoring station, a plurality of successive check-in messages, wherein the successive check-in messages include an anticipated next check-in time corresponding to a predetermined programmable time period.

13. The system of claim 12, wherein the central alarm monitoring station transmits an alert to a third party dispatch upon the expiration of the anticipated next check-in time.

14. The system of claim 9, wherein the alarm monitoring system is further configured to:

receive, by the protected premises panel, within the predetermined supervision period, a disarm event and transmitting a check-off message to the central alarm monitoring station to reset the supervision period.

15. The system of claim 9, wherein the alarm monitoring system is further configured to;

add an additional time period to the predetermined supervision period to compensate for potential network communication delay.

16. The system of claim 9, wherein the supervision period is stored in a check-in supervision table in a memory of the central alarm monitoring station.

* * * * *